US011012785B2

(12) United States Patent
Coates

(10) Patent No.: US 11,012,785 B2
(45) Date of Patent: May 18, 2021

(54) ELECTROACOUSTIC DRIVER AND RELATED LOUDSPEAKER/SOUNDER

(71) Applicant: Eaton Intelligent Power Limited, Dublin (IE)

(72) Inventor: David Andrew Coates, England (GB)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/461,945

(22) PCT Filed: Nov. 15, 2017

(86) PCT No.: PCT/GB2017/053438

§ 371 (c)(1),
(2) Date: May 17, 2019

(87) PCT Pub. No.: WO2018/091889

PCT Pub. Date: May 24, 2018

(65) Prior Publication Data

US 2019/0268700 A1 Aug. 29, 2019

(30) Foreign Application Priority Data

Nov. 18, 2016 (GB) ..... 1619516

(51) Int. Cl.
*H04R 11/02* (2006.01)
*H04R 1/02* (2006.01)
(Continued)

(52) U.S. Cl.
CPC ..... *H04R 11/02* (2013.01); *H04R 1/02* (2013.01); *H04R 1/30* (2013.01); *H04R 13/00* (2013.01)

(58) Field of Classification Search
CPC ..... H04R 11/02; H04R 13/00; H04R 1/30; H04R 1/02
See application file for complete search history.

(56) References Cited

U.S. PATENT DOCUMENTS 2,492,255 A * 12/1949 Angehrn ..... H04R 11/02 381/189
3,497,638 A * 2/1970 Cohen ..... H04R 13/00 381/405

(Continued)

FOREIGN PATENT DOCUMENTS

DE 3312318 A1 * 10/1984 ..... H04R 1/025
JP H0256199 A 2/1990
WO WQ-2010004285 A1 * 1/2010 ..... H04R 13/00

OTHER PUBLICATIONS

International Search Report for PCT/GB2017/053438, dated Feb. 6, 2018, 2 pages.

*Primary Examiner* — Oyesola C Ojo
(74) *Attorney, Agent, or Firm* — Stinson LLP

(57) ABSTRACT

The present invention provides for an electroacoustic driver for use within an explosion proof loudspeaker or sounder and comprising a housing enclosing a coil of an electromagnet, the coil operatively coupled to an electromagnet core, a diaphragm located outside the housing for generating audible sound waves, a magnetic element located outside the housing and coupled to the diaphragm, wherein the electromagnet core extends through a wall of the housing from inside to outside of the housing to interact with the said magnetic element to cause movement of the diaphragm.

12 Claims, 2 Drawing Sheets

(51) Int. Cl.
*H04R 1/30* (2006.01)
*H04R 13/00* (2006.01)

(56) References Cited

U.S. PATENT DOCUMENTS

| | | | | | |
|---|---|---|---|---|---|
| 3,798,391 | A * | 3/1974 | Parker | H04R 11/02 | 381/417 |
| 4,151,379 | A * | 4/1979 | Ashworth | H04R 3/08 | 381/402 |
| 9,100,740 | B2 * | 8/2015 | Huang | H04R 9/025 | |
| 2007/0071065 | A1 * | 3/2007 | Pils | G01K 5/46 | 374/163 |
| 2015/0131844 | A1 * | 5/2015 | Qu | H04R 9/025 | 381/412 |
| 2015/0146910 | A1 * | 5/2015 | Beer | H04R 7/16 | 381/398 |

* cited by examiner

ELECTROACOUSTIC DRIVER AND RELATED LOUDSPEAKER/SOUNDER

CROSS-REFERENCE TO RELATED APPLICATIONS

This application is a National Stage Entry of, and claims priority to, PCT Patent Application No. PCT/GB2017/053438, filed Nov. 15, 2017, which claims priority to United Kingdom Patent Application No. 1619516.6, filed Nov. 18, 2016, both of which are hereby incorporated by reference in their entirety.

FIELD OF THE DISCLOSURE

The present invention relates to an electroacoustic driver and in particular to a speaker or sounder provided with such a driver and that can be arranged for operation within a hazardous area.

BACKGROUND

Sound output devices such as speakers and sounders are commonly employed within, for example, industrial and/or processing environments comprising hazardous areas and environments. Such areas and environments include in particular those where there is the danger of explosion due for example to the possible presence of explosive gages and/or dust. For such areas classified as hazardous, it can prove essential that an electroacoustic driver unit is present so as to provide for audible sounds/signals such as for communication and/or alarm purposes.

The required use in such hazardous areas dictates that the electroacoustic driver unit has to exhibit a housing offering a sufficient degree of sealing so as to prevent any potentially explosive event occurring within the housing travelling to the hazardous area/environment within which the housing is located.

One form of speaker or sounder arranged for use within a hazardous area employs a sintered material to seal the housing and which, while allowing an audible signal to pass through, provides a sufficient degree of isolation to prevent any explosive event within the housing travelling into the hazardous area/environment.

However, various limitations and disadvantages are exhibited by such known arrangements. While allowing the required sound to be output into the area/environment, the sintered element nevertheless serves to attenuate the sound output from the driver thereby limiting the effective volume of its output. Sintered elements are also relatively expensive features of such known designs. Also, such sintered elements commonly allow for water ingress and, if insufficiently dense, can also allow for dust ingress making such known driver units unsuitable for explosive dust-laden atmospheres.

Further, should an explosive event occur within the housing, the sintered element will experience a rise in temperature which reduces the threshold minimum temperature of the atmosphere into which such a known sintered sound/speaker can be safely deployed. It is also required to limit the gas volume within the housing behind the sintered element to reduce any temperature rise resulting from an internal explosive event and also to reduce mechanical stress on the sintered element. Such requirement for limitation of the gas volume serves to complicate the mechanical design of such known explosion-proof speaker/sounder and thereby disadvantageously increasing cost.

Also, and partly to compensate for the sound attenuation by the sintered element, such known speakers/sounders require a relatively large magnet and can prove restrictively expensive.

Various attempts to overcome the limitations of such known sounders/speakers have been made so as to provide for electrostatic drivers not requiring a sintered element such as for example GB 2 461 867 A. However, the strength required for the housing disadvantageously restricts the coupling of the magnetic flux and thus the operation and efficiency of the driver. Also, the particular dimensions required for restricting a flame path through any required openings in the housing also serve to limit the practicalities of known arrangements.

SUMMARY OF THE DISCLOSURE

The present invention therefore seeks to provide an electroacoustic driver having advantages over known such drivers and, in particular, having advantages for known such drivers arranged for use within hazardous areas where, for example, there is potential for explosion.

It is a particular object of the present invention to provide an explosion-proof sounder/speaker having advantages over known such sounders/speakers through avoiding the need for a sinterless element, and/or allowing for a cost effective and simple design and with reduced attenuation of the output audible signal.

According to one aspect of the present invention there is provided an electroacoustic driver comprising a housing enclosing a coil of an electromagnet, the coil operatively coupled to an electromagnet core, and wherein the electromagnet core extends through a wall of the housing from inside to outside of the housing and is arranged for interaction outside the housing with a magnetic element coupled to a diaphragm.

The invention is advantageous in that efficient coupling of the magnetic flux between the electromagnet core and the magnetic element of the diaphragm can be achieved without compromising safety and sound volume/quality.

In a particular example, the electromagnet core can comprise an elongate member as this configuration is particularly effective for operatively bridging the separation of the inner volume of the housing and the external environment.

To enhance the potential for practical employment of the driver, the housing can be arranged to define a sealed enclosure.

In particular, the housing can define any one or both of a flame-proof enclosure, and an explosion-proof enclosure.

The electromagnet core can be arranged to protrude through an opening in the housing wall, which opening advantageously comprises a feature of the housing that can be readily sealed.

In particular, opening comprises a sealed joint to the electromagnet core extending there through, and in particular the joint can comprise a flame-proof joint.

Preferably, the invention can provide for a loudspeaker or sounder including an electroacoustic driver as claimed in any one or more of the preceding claims, and including a diaphragm located outside the housing for generating audible sound waves, a magnetic element located outside the housing and coupled to the diaphragm, and wherein the electromagnet core interacts with the said magnetic element.

Advantageously, the said magnetic element can comprise a small, and if required light-weight, planar element.

In one arrangement, the said magnetic element is mounted directly to the diaphragm, for example by way of an adhesive.

To enhance the coupling of the magnetic flux the lateral dimensions of the said magnetic element correspond substantially to the transverse cross section of the region of the electromagnet core located externally to the housing.

As will be appreciated, the present invention offers clear advantages over known explosion-proof speakers/sounders, in that the sound from the diaphragm is not attenuated by the need for a sealed housing and also no sintered element is required.

Only a relatively small and light permanent magnet is required to be coupled to, or mounted on the diaphragm and this can advantageously serve to extend the frequency range of audible output from the unit speaker/sounder.

There is further no potential for an external temperature rise due to any internal explosion event since the housing, having an appropriate wall structure, can readily be provided without limiting the operation of the device.

Yet further, and in view of the structural rigidity of the housing, and which can be enhanced through the absence of any sintered element, the gas volume directly behind the diaphragm does not need to be limited and this further serves to reduce the complexity of the internal configuration and mechanical design of the housing.

The configuration of the electromagnet core extending through the housing wall lends itself in particular to a readily sealable housing.

BRIEF DESCRIPTION OF THE DRAWINGS

The invention is described further hereinafter with reference to the accompanying drawings in which.

DETAILED DESCRIPTION

Figure 1:
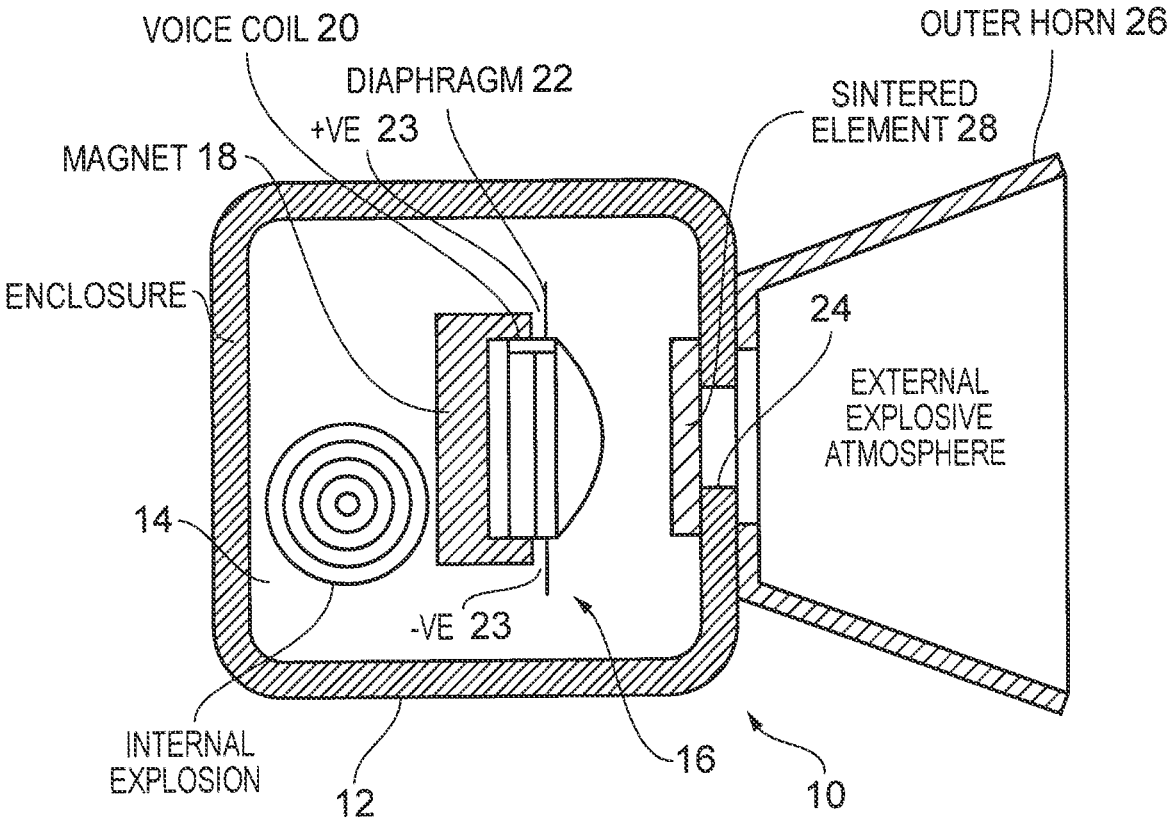
FIG. 1 (Prior Art)
FIG. 1 is a schematic sectional view of an explosion-proof loudspeaker known in the current art.

Turning first to FIG. 1, there is illustrated a sounder/speaker assembly 10 comprising a housing 12 enclosing an internal volume 14 in which there is located an electroacoustic driver 16 comprising a relatively large permanent magnetic 18, a voice coil 20 mounted to a diaphragm 22. The driver and diaphragm are arranged to supply, in response to an audio signal at the positive/negative terminals 23, audible sound waves arranged to exit the housing 12 by way of an opening 24. Beyond the opening 24 on the outside of the housing 12 is a frustro-conical outer horn 26 serving to amplify the output audible signal.

In order to provide sufficient sealing of the housing 12, so as to effectively isolate it from the external environment and so prevent any internal explosion event within the internal volume 14 from travelling to the external environment, a flame arrestor in the form of a flat disk like sintered element 28 is provided to close the opening 24 and offer the required isolation between the enclosure internal volume 14 and the hazardous environment external to the housing 12.

The sound waves created by the driver 16 can however pass through this sintered element 28 and onward via the outer horn 26 although a relatively large degree of attenuation occurs due to the sintered element 28. Such attenuation can, to some extent, be compensated for by an overly large and expensive driver 16 and associated magnet 18.

While such "sintered" explosion-proof sounders/speakers such as that illustrated in FIG. 1 are commonly deployed in hazardous areas, they nevertheless exhibit disadvantages and limitations as referred to earlier.

In particular, the sintered element 28 is relatively expensive and disadvantageously attenuate the sound output from the driver 16. Sintered elements 28 will also allow for a degree of water ingress and, if insufficiently dense, will also allow for dust ingress which rendered such known devices 10 unsuitable for use in explosive dust-atmospheres. Also, sintered elements 28 will experience a relatively high temperature rise during an explosive event within the internal volume 14 and so this serves to limit the ambient temperature of the environment into which such known devices can again be safely deployed. In an attempt to reduce temperature rises within the internal volume 14, the gas volume therein is often minimised in an attempt to reduce any internal temperature rises due to an explosive event. Also, the gas volume behind the sintered element 28 is also commonly limited to reduce mechanical stress on the element and this disadvantageously serves to complicate the mechanical design and cost of such known loudspeaker/sounder assemblies.

Figure 2:
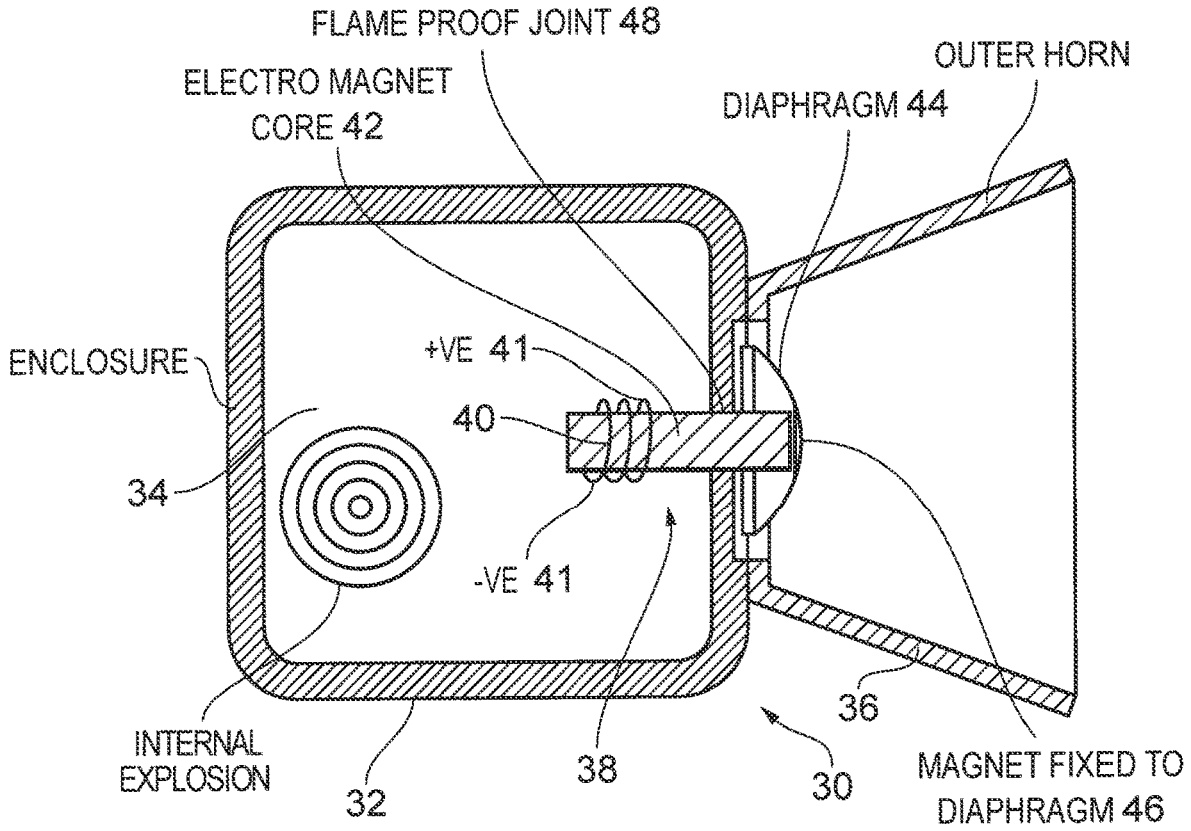
FIG. 2 is a similar schematic sectional view of a loudspeaker employing an electroacoustic driver according to an embodiment of the present invention.

Turning now to FIG. 2, there is provided a schematic sectional view of an electroacoustic driver and associated loudspeaker/sounder according to one embodiment of the present invention and as comprising a speaker/sounder 30 for use in a hazardous environment.

The illustrated example of the present invention provided by FIG. 2 again comprises a housing 32 enclosing an internal volume 34 and a frustro-conical outer horn 36 mounted to the outside of the housing and from which sound waves are to emanate.

An electroacoustic driver 38 is again provided and this time comprises, in addition to the housing 32, a coil 40 arranged to receive audio signals via the positive and negative supply terminals 41, an electromagnet core 42 and arranged to interact with a diaphragm 44. In the illustrated example, the diaphragm 44 comprises a dome having an inner surface facing towards the housing 32, and an outer surface facing outwardly of the outer horn 36.

Mounted centrally on the inner surface of the diaphragm 44 is a small disc-shaped permanent magnet 46 arranged to interact with the electromagnet core 42 of the driver 38.

As will be appreciated, the electromagnet core 42 comprises an elongate cylindrical member which extends through an opening 48 in the housing 32 from the inner volume 34 to the exterior of the housing 32 to a position closely adjacent to, but separate from, the magnet 46 fixed to the diaphragm 44. The coil 40 that serves to excite the electromagnet 42 however is located solely within the internal volume 34 of the housing 32.

Through appropriate sealing between the electromagnet core 42 and opening 48 in the housing wall, such as by way of a flame-proof joint, the internal volume 34 of the housing 32 can be effectively isolated from the external environment within which the outer horn 36 and diaphragm 44 are located, thereby providing a simple but efficient explosion-proof loudspeaker/sounder.

As will be appreciated, a particular feature of the present invention is that an elongate electromagnet core 42 of an electromagnet device extends from within the inner volume 34 of the housing 32, through a suitably sealed joint of the housing wall, to a region outside of the housing within the hazardous environment. The coil 40 of the electromagnet is located wholly within the internal volume 34 of the housing 32 such that any explosive event arising for example in connection with the operation of the coil 40 is restricted only to within the internal volume 34. However, since the electromagnet core 42 is arranged to interact with the permanent magnet 46 fixed to the diaphragm 44 at a location outside of the housing 32 there is no potential for an explosive event being initiated though the operation of the electromagnet. Also, since part of the electromagnet core 42 and the permanent magnet 46 mounted to the diaphragm 44 are located outside no attenuation of the sound signals emanating from the diaphragm 44, and via the outer horn 36 will arise due to the necessarily sturdy and explosion-proof housing 32.

The electromagnet core 42 therefore advantageously effectively forms an operational bridge between the internal volume 34 and its coil 40 and the hazardous area external to the housing 32 and the diaphragm 44 and its permanent magnet 46, to allow for the efficient operation of the electromagnet 40, 42 and the diaphragm 44 whilst also serving to seal the internal volume 34 of the housing 32 from the external hazardous environment.

As noted, the opening in the housing 32 through which the electromagnet core 42 extends can comprise a flame-proof joint.

As will be appreciated, the present invention offers clear advantages over known explosion-proof speakers/sounders, and the illustrated embodiment of FIG. 2 offers particular advantages over the prior art speakers/sounders such as that illustrated in relation to FIG. 1. In particular, it will be appreciated that the sound from the diaphragm 44 is not attenuated and, also, no specific flame arrestor such as the sintered element is required.

Yet further, only a relatively small and light permanent magnet is required to be coupled to, or mounted on the diaphragm and this can advantageously serve to extend the frequency range of audible output from the unit speaker/sounder.

There is further no potential for an external temperature rise due to any internal explosion event since the housing 32, having an appropriate wall structure, can readily be provided without limiting the operation of the device. In this manner, the ambient temperature into which the device of the present invention can be employed can be advantageously higher than that for known devices.

Yet further, and in view of the structural rigidity of the housing, and which can be enhanced through the absence of any sintered element, the gas volume directly behind the diaphragm does not need to be limited as it is in the prior art and this further serves to reduce the complexity of the internal configuration and mechanical design of the housing 32.

The nature of the sealing and isolation of the electromagnet core 42 within the opening of the housing 32, such as by way of a flame-proof joint 48, can readily serve to prevent water and dust ingress and thereby provide for a speaker/sounder unit suitable for use in explosive dust-atmospheres so that required safety ratings can be readily achieved.

The housing of the invention can be made from a variety of materials and at various different thicknesses. As one example, the invention can be realized with an enclosure formed from cast of fabricated steel which can be in the region of 5 mm thick. Cast aluminium can also be employed, for example at a thickness of 7 mm to 8 mm, or indeed a Glass Reinforced Polymer moulding of thickness in the order of 10 mm to 12 mm can be employed. Of course the invention is not limited to such selections and dimensions and any appropriate combination can be employed.

It should be appreciated that the embodiment illustrated with reference to FIG. 2 is only one example of the present invention and which is therefore not limited to the details of the illustrated embodiment. For example, any form/shape of housing can be provided as indeed can any configuration of electromagnet design and diaphragm/outer horn design.

Any appropriate form/configuration of permanent magnet can be affixed to the diaphragm and the diaphragm can be provided in any appropriate form and shape and with permanent magnet coupled for movement therewith either through a coupling arrangement or through direct fixation as illustrated.

Of course, the degree of sealing offered by the housing 32 can be determined on the basis of the join between the electromagnet core 42 and the aperture in the wall of the housing 32 through which the electromagnet core 42 protrudes into the external environment.

While a flame-proof joint is suggested, any appropriate degree or form of sealing can be provided between the electromagnet core 42 and housing wall dependent upon the nature of the seal required and the particular environment within which the sounders/speakers to be provided.

Also, reference to a loudspeaker and sounder are intended to encompass an electroacoustic transducer-based device for outputting any form of audible sound wave or signal.

The invention claimed is:

1. An electroacoustic driver comprising:

a housing enclosing a coil of an electromagnet, the coil operatively coupled to an electromagnet core, wherein the electromagnet core extends through a wall of the housing from inside to outside of the housing through an opening in the housing wall, wherein the opening comprises a sealed joint to the electromagnet core, wherein the sealed joint is flame proof, and wherein the electromagnet core is arranged for interaction outside the housing with a magnetic element coupled to a diaphragm, and wherein the housing defines a flame-proof enclosure.

2. A driver as claimed in claim 1 wherein the electromagnet core comprises an elongate member.

3. A driver as claimed in claim 1, wherein the electromagnet core comprises a cylindered member.

4. A driver as claimed in claim 1 wherein the housing defines a sealed enclosure.

5. A driver as claimed in claim 1 wherein the housing defines an explosion-proof enclosure.

6. A loudspeaker or sounder comprising:

an electroacoustic driver as claimed in claim 1, a diaphragm located outside the housing for generating audible sound waves, and a magnetic element located outside the housing and coupled to the diaphragm, wherein the electromagnet core interacts with the said magnetic element.

7. A loudspeaker or sounder as claimed in claim 6, wherein the said magnetic element comprises a small planar element.

8. A loudspeaker or sounder as claimed in claim 6 wherein the said magnetic element is mounted directly to the diaphragm.

9. A loudspeaker or sounder as claimed in claim 8, wherein the said magnetic element is mounted to the diaphragm by way of an adhesive.

10. A loudspeaker or sounder as claimed in claim 6, wherein the lateral dimensions of the said magnetic element correspond substantially to the transverse cross section of the region of the electromagnet core located externally to the housing.

11. A driver as claimed in claim 1 further including an outer horn surrounding the said diaphragm, the outer horn being directly attached to the housing.

12. A driver as claimed in claim 11 wherein the electromagnetic core extends past the housing.

* * * * *